US009427677B1

(12) United States Patent
Bray et al.

(10) Patent No.: US 9,427,677 B1
(45) Date of Patent: Aug. 30, 2016

(54) ADJUSTABLE HEIGHT HURDLE

(71) Applicant: Litania Sports Group, Inc., Champaign, IL (US)

(72) Inventors: Christopher E. Bray, Champaign, IL (US); Bryan R. Carrel, Urbana, IL (US); Gregory W. Luebbering, Heyworth, IL (US)

(73) Assignee: Litania Sports Group, Inc., Champaign, IL (US)

( * ) Notice: Subject to any disclaimer, the term of this patent is extended or adjusted under 35 U.S.C. 154(b) by 0 days.

(21) Appl. No.: 14/816,355

(22) Filed: Aug. 3, 2015

(51) Int. Cl.
*A63B 21/00* (2006.01)
*A63K 3/04* (2006.01)

(52) U.S. Cl.
CPC ..... *A63K 3/043* (2013.01)

(58) Field of Classification Search
CPC ..... A63B 21/00
USPC ..... 482/15, 14, 148
See application file for complete search history.

(56) References Cited

U.S. PATENT DOCUMENTS 4,749,187 A 6/1988 Dellinger et al.
5,352,057 A 10/1994 Zody
7,438,668 B1 10/2008 Watry et al.
8,968,157 B2 3/2015 Lindstrom

*Primary Examiner* — Jerome W Donnelly
(74) *Attorney, Agent, or Firm* — Philip L. Bateman

(57) ABSTRACT

An adjustable height hurdle has a wall with a plurality of vertically spaced apart bores inside each upright. A vertical actuator inside each upright and gate tube engages the bores. The exteriors of the uprights and gate tubes are solid so that no dirt or water enters the interior of the hurdle.

6 Claims, 4 Drawing Sheets

ADJUSTABLE HEIGHT HURDLE

FIELD OF THE INVENTION

This invention relates to exercise devices. More particularly, this invention relates to track and field equipment. Still more particularly, this invention relates to hurdles.

BACKGROUND OF THE INVENTION

Track and field is a sport in which athletes compete in running, jumping, and throwing events. Two events that combine running and jumping are known as the hurdles. In the hurdles, the athletes run in designated lanes and jump over spaced apart hurdles in between the start and finish. A hurdle consists of a base having two legs, two uprights, and a horizontal gate board (sometimes spelled "gateboard"). In the first hurdle event (commonly known as the high hurdles), athletes run about 100 meters and jump over relatively high hurdles. In the second hurdle event (commonly known as the low or intermediate hurdles), athletes run about 400 meters and jump over lower hurdles.

A hurdle is designed to tip over if the athlete contacts it. The force at the gate board required to tip the hurdle over is commonly known as its pull over weight. The pull over weight is a function of the height of the hurdle. Other things being equal, the pull over weight decreases as the height of the hurdle increases. Most hurdles contain added counterweights in the base to achieve the desired pull over weight. To maintain a constant pull over weight as the height of the hurdle changes, many modern hurdles incorporate counterweights that move in the legs of the base. As the height of the hurdle increases, the counterweights are moved further away from the uprights and, as the height of the hurdle decreases, the counterweights are moved toward the uprights. In some hurdles, the counterweights are moved manually. In other hurdles, the counterweights are connected mechanically to the gate board so that they move automatically as the gate board is moved.

The height of the hurdle in each of the hurdle events varies depending upon the age and sex of the athletes. For versatility and economy, most hurdles are adjustable in height. Adjustable hurdles contain a gate board that is attached to movable gate tubes (also known as risers) that telescope inside or outside the stationary uprights. Either the uprights or the gate tubes (whichever is outer) contain spaced apart vertical bores in their outer surfaces. One of the simplest height adjustment systems consists of a detent pin that is biased outwardly. For example, Zody, U.S. Pat. No. 5,352,057, Oct. 4, 1994, discloses an adjustable height hurdle having a detent pin in each inner upright that extends through a selected bore in each outer gate tube. Adjusting the height of the hurdle requires a person to bend down over to reach the detent pins.

More ergonomic hurdle height adjustment systems contain a vertical actuator with a distal pin that extends through a selected bore in the upright and a handle (sometimes referred to as a trigger or button) that extends out of each gate tube. The vertical actuator is typically biased in one direction by a spring to force the post into the bore. Squeezing, depressing, or otherwise moving the handle moves the member and disengages the post from the bore. A variety of height adjustment systems are used in hurdles. As examples, a mechanism with a manipulator and latch is disclosed in Dellinger et al., U.S. Pat. No. 4,749,187, Jun. 7, 1988; a mechanism with triggers and contiguous trigger tubes is disclosed in Watry et al., U.S. Pat. No. 7,438,668, Oct. 21, 2008; and a mechanism with a locking pin and a tension spring is disclosed in Lindstrom, U.S. Pat. No. 8,968,157, Mar. 3, 2015.

A major problem with conventional adjustable height hurdles with automatic counterweight systems is that dirt and water can enter the interior of the hurdle through the external bore holes and interfere with the counterweight system. Accordingly, there is a demand for an adjustable height hurdle without external bores in the uprights.

SUMMARY OF THE INVENTION

The general object of this invention is to provide an improved hurdle. A more particular object is to provide an adjustable height hurdle without external bores in the uprights.

We have invented an improved adjustable height hurdle. The hurdle comprises: (a) two substantially parallel horizontal hollow legs, each leg having a leading end and a trailing end; (b) two stationary hollow uprights, each upright extending upwardly from the trailing end of a leg, and defining an intersection between a leg and an upright; (c) two movable hollow gate tubes, each gate tube telescoping relative to an upright and having a top end; (d) a gate board connecting the top ends of the gate tubes, the gate board having a top that defines a hurdle height; and (e) a height adjustment system for adjusting the hurdle height to a plurality of defined heights, the height adjustment system comprising: (i) a wall inside each upright, each wall having a plurality of vertically spaced apart bores; and (ii) a vertical spring loaded actuator inside each upright and gate tube, each actuator having a top attached to the gate tube, a bottom, a post at the bottom that engages a selected bore in the wall inside each upright, and a handle at the top for disengaging the actuator.

The hurdle of this invention has no bores in the exteriors of the uprights so that no dirt or water can enter the interior.

DETAILED DESCRIPTION OF THE INVENTION

1. The Invention in General

Figure 1:
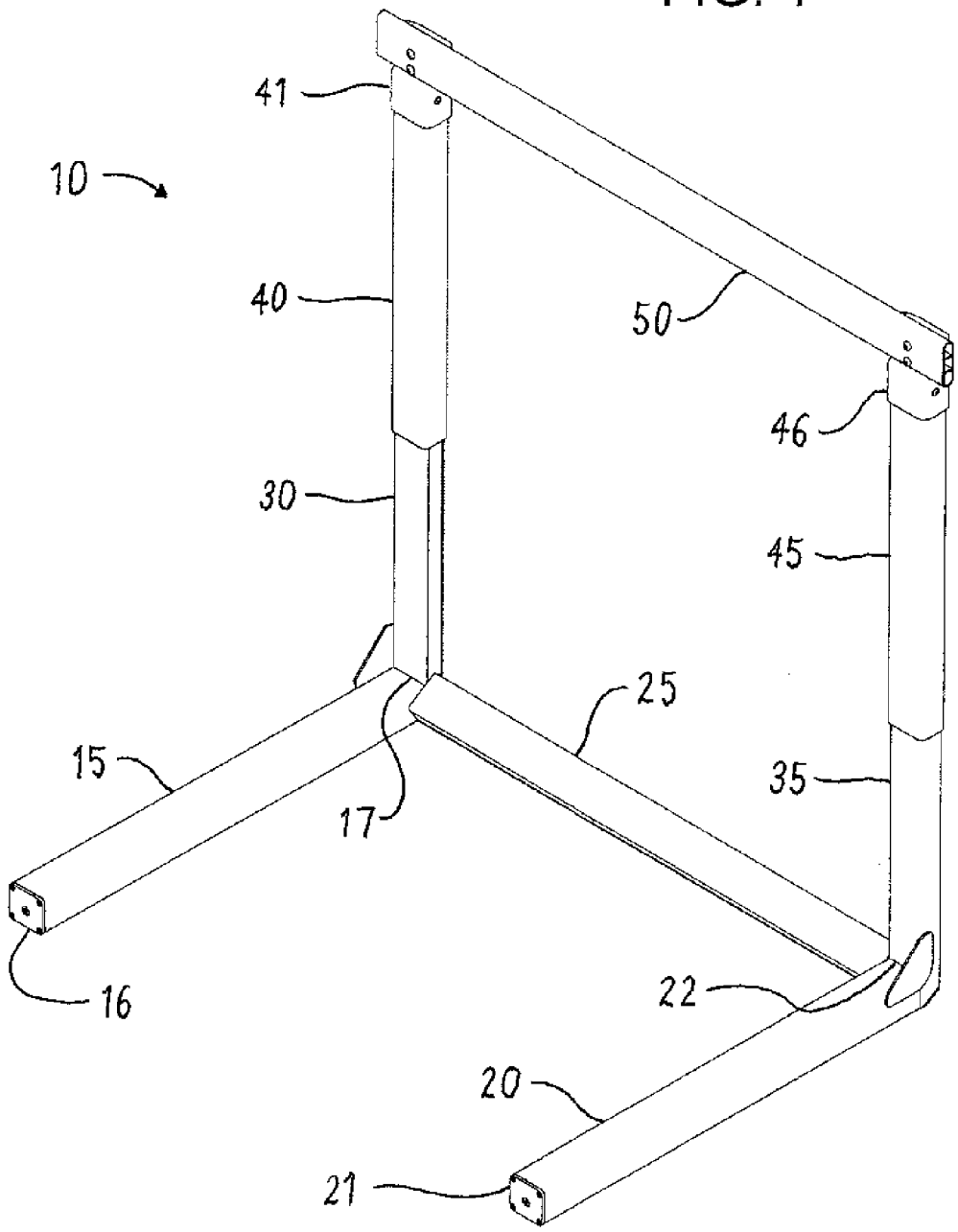
FIG. 1 is a front and right side perspective view of the exterior of a preferred embodiment of the hurdle of this invention.

This invention is best understood by reference to the drawings. A preferred embodiment of the hurdle 10 of this invention has two legs 15 and 20 and a cross support 25. Two stationary uprights 30 and 35 extend upwardly from the legs. The legs, cross support, and uprights are often collectively referred to as the base assembly. Two movable telescoping gate tubes 40 and 45 fit over the uprights. A gate board 50 connects the top ends of the telescoping gate tubes. The gate tubes and gate board are often collectively referred to as the riser assembly. A height adjustment system 60 enables the position of the riser assembly relative to the base assembly to be varied. An internal counterweight system 70 automatically moves a counterweight in each leg to maintain the pull over weight relatively constant as the height of the gate board is varied. The components are discussed in detail below.

2. Dimensions

The size of the hurdle is typically set by a track and field governing body. The hurdle generally has a width of either about forty-one inches or about forty-seven inches and the height of the hurdle (measured from the ground to the top of the gate board) is generally adjustable between about thirty and forty-two inches. The height of the hurdle is fixed by the position of the riser assembly relative to the base assembly. The hurdle preferably contains a plurality of set height adjustments. In the preferred embodiment, each upright has five adjustments for the following categories: (1) women's low; (2) women's high; (3) men's intermediate; (4) high school boy's high; and (5) men's high.

3. Legs

The hurdle contains two horizontal legs 15 and 20 having a length that is typically set by a track and field governing body. The legs are hollow to accommodate the counterweight system. The legs are substantially parallel so they do not intrude upon the lane in which the hurdle is located or upon the adjacent lanes. Each leg has a leading end 16 and 21 and a trailing end 17 and 22. The terms "leading" and "trailing" refer to the direction from which the athlete approaches the hurdle. The legs are preferably joined by a cross support 25 to provide more structural strength. In the preferred embodiment, the cross support connects the trailing ends of the legs. Alternatively, the cross support can be positioned between the lower ends of the uprights. The legs and cross support are preferably made of rectangular aluminum tubing with a width of about two to three inches.

4. Uprights

Stationary hollow uprights 30 and 35 extend upwardly from the trailing ends of the legs. In the preferred embodiment, the uprights are made of rectangular aluminum tubing with a width of about two to three inches. In the preferred embodiment, molded plastic caps 31 and 36 fit into the tops of the gate tubes. As explained below, the plastic caps contain guides and attachment points for components of the height adjustment system and the counterweight system. As previously mentioned, the uprights, legs, and cross support are commonly known collectively as the base assembly.

Each upright contains an internal wall 61 with a plurality of vertically spaced apart bores that, in combination with the height adjustment mechanism on each side, are used to set the height of the hurdle. The internal walls preferably contain five bores for the five standard hurdle heights. As explained below, locating the bores in an internal wall eliminates the entry of dirt and water into the interior of the hurdle.

5. Gate Tubes

Telescoping gate tubes 40 and 45 fit over, within, or beside the uprights. In the preferred embodiment, the gate tubes are rectangular aluminum tubes that fit over the stationary uprights. The inside dimensions of the telescoping tubes are preferably slightly greater than the outside dimensions of the upright tubes so the telescoping gate tubes can move freely up and down. In the preferred embodiment, molded plastic caps 41 and 46 fit onto the tops of the gate tubes. The plastic caps contain recesses for the attachment of the gate board and for connection of components of the height adjustment system.

6. Gate Board

A gate board 50 connects the tops of the gate tubes. In the preferred embodiment, the gate board is attached to the caps on the gate tubes. The gate board has a height of about two to four inches and is generally made of a durable lightweight material such as LEXAN polycarbonate, polyvinyl chloride (PVC), wood, or the like. As previously mentioned, the assembly of the gate board and the telescoping gate tubes is commonly known as the riser assembly. To adjust the height of the hurdle, the riser assembly is moved relative to the base assembly (the legs, cross support, and uprights).

7. Height Adjustment System

Figure 2:
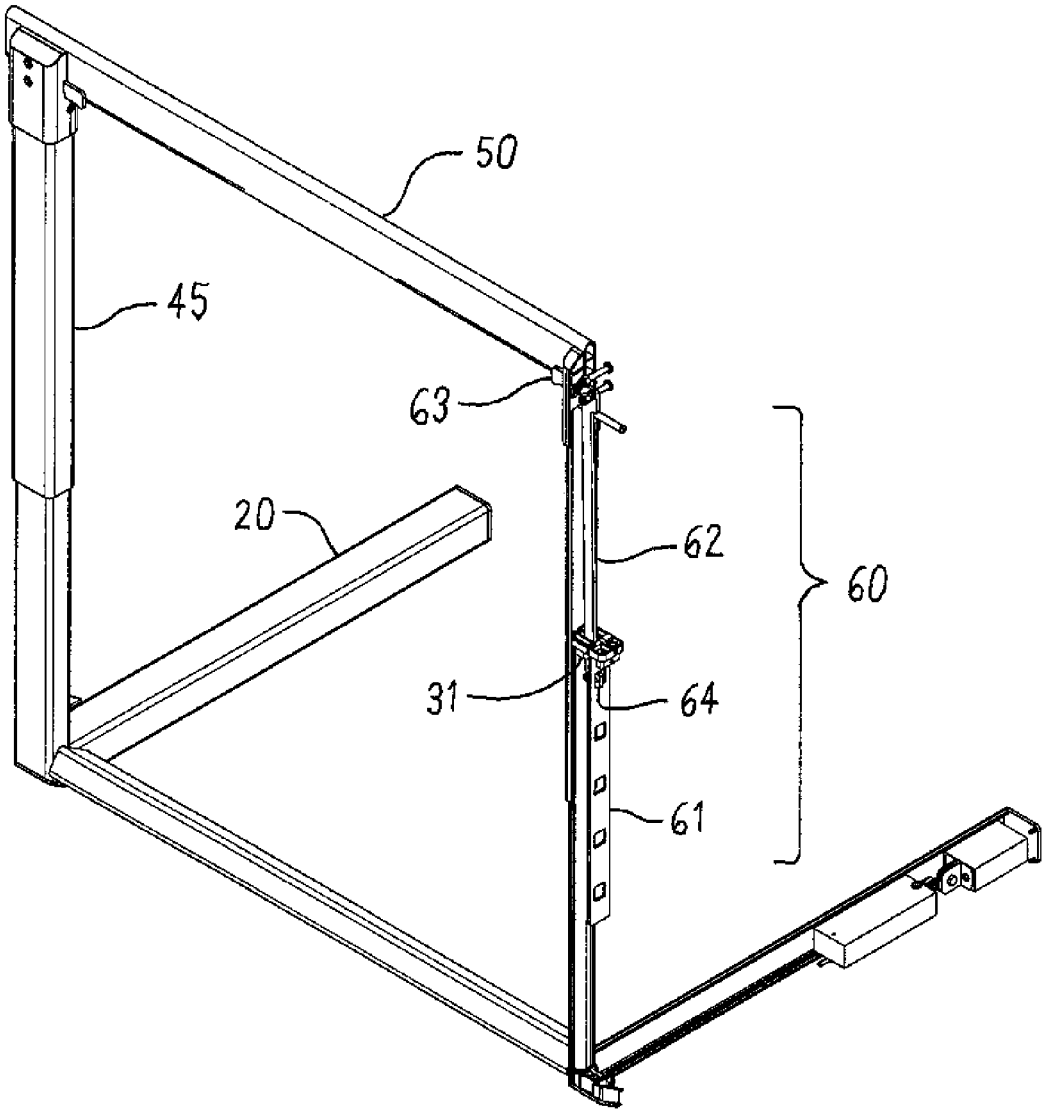
FIG. 2 is a rear and left side cutaway perspective view thereof with the left side interior height adjustment system shown.

FIG. 2 shows the preferred embodiment of the hurdle with the left leg, upright, and gate tube omitted (cut away) to show the interior. The height adjustment system 60 has no bores in the outer surface of the stationary uprights or the gate tubes. Instead, its height adjustment system includes an internal wall 61 inside each upright with a plurality of spaced apart bores 60*a*. The number and shape of the bores are matters of choice. As previously mentioned, the internal walls preferably contain five square bores for the five standard hurdle heights.

Figure 4:
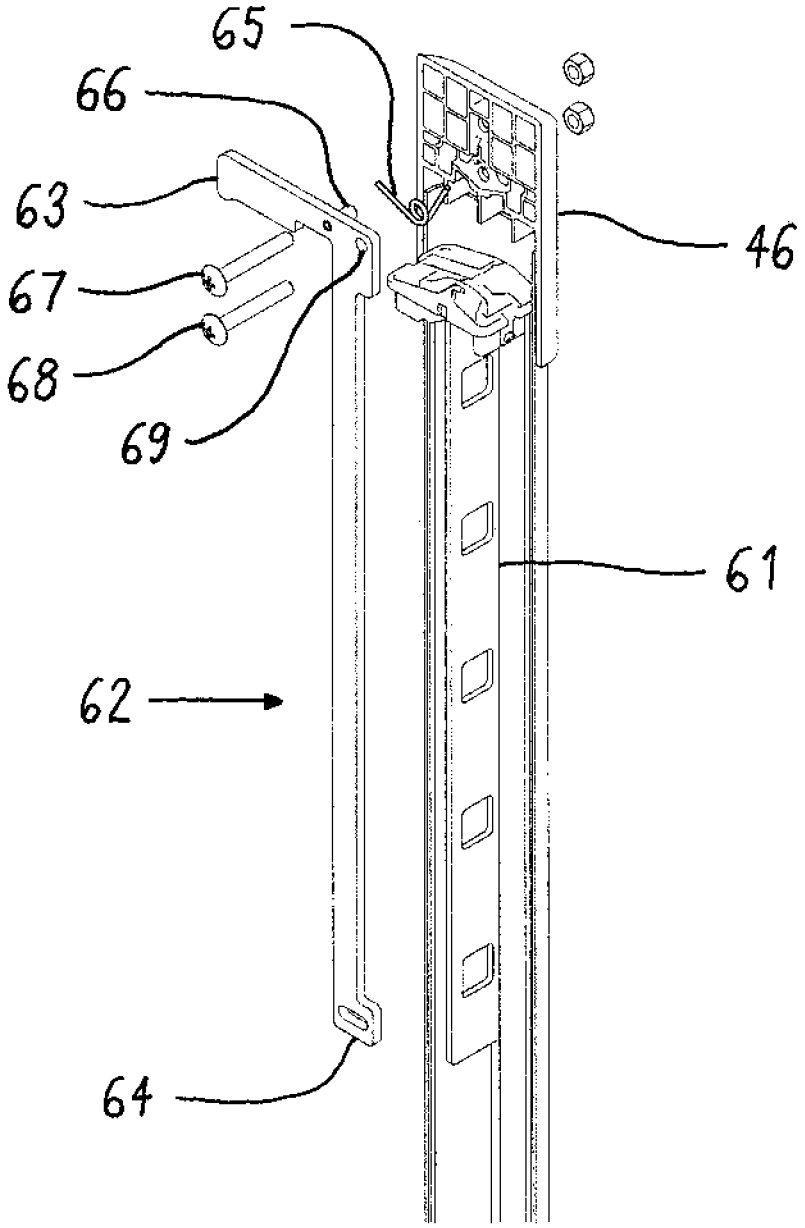
FIG. 4 is an exploded perspective view of components of the height adjustment system.

FIG. 4 shows the components of the height adjustment system in more detail. The height adjustment mechanism on each side includes a vertical actuating rod 62 with a handle 63 at its top and a horizontally projecting post 64 at its bottom. The top of the rod fits into a recess in the cap 46 on top of the gate tube. A torsion spring 65 engages a rearwardly projecting member 66 in the top of the rod and also engages the cap to bias the post in an outward direction for engagement in a bore in the internal wall. An upper threaded pin 67 and a lower threaded pin 68 attach the gate board (omitted from FIG. 4 for clarity) to the cap. The lower threaded pin also passes through an opening 69 in the actuating rod and then through the torsion spring to provide a pivot point. When a handle is squeezed, the post moves inwardly to disengage and the gate tube is free to telescope. When the handle is released, the post moves back outwardly into one of the bores. Locating the height adjustment bores in an internal wall eliminates the problems caused by the entry of dirt and water through external bores into the interior of the hurdle.

8. Counterweight System

The counterweight system 70 maintains the pull over weight relatively constant as the height of the gate board is varied. The particular mechanism of the counterweight system is a matter of choice. In the preferred embodiment, the counterweight system includes a counterweight in each leg that is connected to cables that run to the gate tube.

Figure 3:
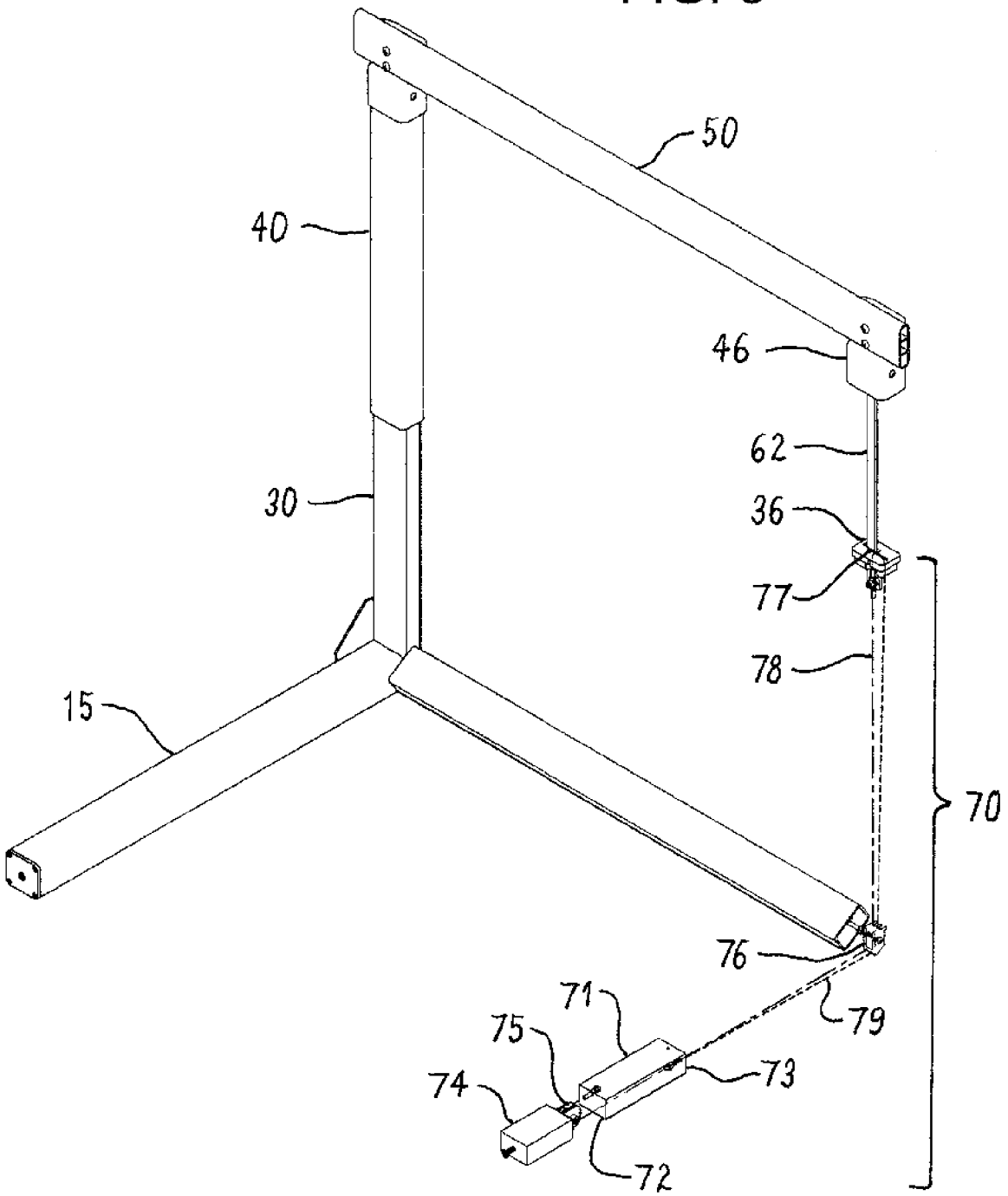
FIG. 3 is a front and right side cutaway perspective view thereof with the right side interior counterweight system shown.

A variety of counterweight systems are used in hurdles and all are suitable for use with the hurdle of this invention. FIG. 3 shows the preferred embodiment of the counterweight system with the right leg, stationary upright, and gate tube omitted (cut away) to show the interior. The system is substantially the same on each side of the hurdle so only the right side is shown and described. The counterweight system includes a counterweight, cable guides, an actuating rod, and cables.

The counterweight 71 has a leading end 72 and a trailing end 73. The shape of the counterweight generally conforms to the shape of the leg. In the preferred embodiment, the leg and the counterweight both have rectangular cross-sections, giving the counterweight the overall shape of a brick. The size of the counterweight is preferably slightly less than the internal size of the leg. In other words, the counterweight is small enough so that it does not bind and large enough that it cannot turn or rotate or otherwise change orientation.

The weight of the counterweight is a matter of choice that depends on the weight and dimensions of the hurdle. The counterweight is preferably made of a dense material such as steel or the like. The counterweight moves back and forth inside the leg so friction between the bottom of the counterweight and interior of the leg is preferably minimized. Smooth surfaces on both the counterweight and the leg interior generally are sufficient. In the preferred embodiment, the leg interior contains reinforcing ribs upon which the counterweight rides, thereby reducing the area of contact and reducing friction. If even less friction is desired, plastic rails, rollers, or the like are added to the counterweight or the leg interior. The counterweight is positioned about midway along the leg when the hurdle is at a middle height so that the counterweight can move in both directions (toward the leading end when the height of the hurdle increases and toward the trailing end when the height of the hurdle decreases).

In addition to a movable counterweight, a permanently mounted counterweight 74 in the leading end of each leg is often desirable to achieve the desired pull over weight.

The internal counterweight system of the preferred embodiment contains three cable guides on each side. The first guide 75 is positioned inside the leading end of the leg. The second guide 76 is positioned at the intersection of the leg and the stationary upright. The third guide 77 is positioned at or near the top the stationary upright. The term "near" the top is used herein to mean within about five inches of the top. The height of the third guide determines the distance the counterweight can travel. For maximum counterweight travel, the third guide is located at the top of the stationary upright. In the preferred embodiment, the third guide is part of the cap 36 that fits into the top of the stationary upright.

The guides are conventional. Non-moving cable guides such as plastic blocks with cable channels or grooves are preferred for their durability. Pulleys are preferred for their decreased friction. Bars, posts, and the like are also suitable as guides. If desired, the counterweight system has cable guides of different types. For example, the preferred embodiment has a pulley at the leading end of the leg and plastic blocks at the other two locations.

The internal counterweight system contains a vertical actuating rod 62 inside the gate tube and stationary upright on each side. The top of the actuating rod is connected directly or indirectly to the gate tube and the bottom of the actuating rod extends into the stationary upright. In the preferred embodiment, the top of the actuating rod is connected to the plastic cap on the gate tube. As explained in detail below, the actuating rod provides an attachment point for the cables that is below the third guide. The actuating rod thus provides the mechanism for applying a pulling force to one of the cables when the gate board is raised and to the other cable when the gate board is lowered. In the preferred embodiment, the actuating rod performs two functions. It forms the connecting point for the cables of the counterweight system and it forms the actuator of the height adjustment mechanism as described above.

The internal counterweight system contains a first cable 78 and a second cable 79 on each side. For illustration purposes, the first cable is shown in alternating long and short broken lines in FIG. 3. One end of the first cable is connected to the leading end of the counterweight. The first cable then runs horizontally to and around the first cable guide at the leading end of the leg. The first cable then runs horizontally in the opposite direction to and around the second cable guide at the intersection of the leg and the upright. The cable then runs vertically up to the bottom of the actuating rod. The cable is attached to the bottom of the actuating rod. The connections of the first cable to the counterweight and actuating rod are matters of choice. For example, fittings such as hooks, screws, or the like are suitable.

For illustration purposes, the second cable is shown in short broken lines in FIG. 3. One end of the second cable is connected to the trailing end of the counterweight. The second cable then runs horizontally to and around the second cable guide at the intersection of the leg and the upright. The second cable then runs vertically up to and around the third cable guide at the top of the stationary upright. The second cable then runs vertically in the opposite direction down to the bottom of the actuating rod. The second cable is attached to the bottom of the actuating rod. The connections of the second cable to the counterweight and actuating rod are identical or similar to the connections to the first cable.

The cable are sufficiently taut that they are retained on the cable guides and drag little against the interior of the legs and uprights. If desired, one or more of the cable guides includes a mechanism for adjusting cable tension. In the preferred embodiment, the first cable guide at the leading end of the legs is attached to a screw whose head is accessible from the exterior of the hurdle. Turning the adjustment screw clockwise causes the cable guide to move toward the trailing end and reduces cable tension. The reverse is achieved by turning the adjustment screw counterclockwise. The cable is preferably made of steel.

9. Operation and Advantages

The operation of the preferred embodiment of the hurdle can now be considered. The height of the hurdle is adjusted by first squeezing the handle, causing the handle to rotate upward about the pivot point provided by the threaded pin. This movement disengages the horizontally projecting post from the bore in the inner wall, allowing the riser assembly to move freely up or down to the desired height. The handle is then released and the torsion spring returns the actuating rod to its original position in which the post engages a bore in the inner wall.

The up or down movement of the riser assembly causes each actuating rod to move. In the preferred embodiment, the movement of the actuating rod causes one of the two cables to be pulled. The pulling of one cable causes the other cable to move as well. As the cables move, the counterweight automatically moves back or forth within the leg to keep the pull over weight relatively constant.

The uprights and the gate tubes of the hurdle contain no external bores through which dirt and water can enter. The entry of dirt and water into a hurdle can interfere with the counterweight system. Once they enter, dirt and water are very difficult to remove. The absence of external bores also gives the hurdle a distinctive and attractive appearance.

We claim:

1. An adjustable height hurdle comprising:

(a) two substantially parallel horizontal hollow legs, each leg having a leading end and a trailing end;

(b) two stationary hollow uprights, each upright extending upwardly from the trailing end of a leg, and defining an intersection between a leg and an upright;

(c) two movable hollow gate tubes, each gate tube telescoping relative to an upright and having a top end;

(d) a gate board connecting the top ends of the gate tubes, the gate board having a top that defines a hurdle height; and (e) a height adjustment system for adjusting the hurdle height to a plurality of defined heights, the height adjustment system comprising:

(i) a wall inside each upright, each wall having a plurality of vertically spaced apart bores; and (ii) a vertical actuator inside each upright and gate tube, each actuator having a top attached to the gate tube, a post that engages a selected bore in the wall inside each upright, and a handle at the top for disengaging the actuator.

2. The hurdle of claim 1 additionally comprising:

(f) a counterweight system for adjusting the pull over weight of the hurdle when the hurdle height is adjusted.

3. The hurdle of claim 2 wherein the counterweight system comprises:

(i) a counterweight inside each leg, each counterweight being movable horizontally and having a leading end and a trailing end;

(ii) a first cable guide attached inside the leading end of each leg;

(iii) a second cable guide attached inside each intersection between a leg and a stationary upright;

(iv) a third cable guide attached inside each stationary upright;

(v) a first cable connected to the leading end of each counterweight, then running horizontally to and around each first cable guide, then running horizontally to and around each second cable guide, then running vertically to and connecting with the actuator; and (vi) a second cable connected to the trailing end of each counterweight, then running horizontally to and around each second cable guide, then running vertically to and around each third cable guide, and then running vertically to and connecting with the actuator.

4. The hurdle of claim 1 additionally comprising a horizontal cross support connecting the trailing ends of the legs.

5. The hurdle of claim 3 wherein at least one of the cable guides is adjustable in position to vary the tension on the cables.

6. The hurdle of claim 3 wherein the third cable guide is attached at or near the top of each stationary upright.

* * * * *